US007198838B2

(12) United States Patent
Hirota

(10) Patent No.: US 7,198,838 B2
(45) Date of Patent: Apr. 3, 2007

(54) PROTECTIVE LAYER TRANSFER SHEET AND PRINT

(75) Inventor: Kenichi Hirota, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 103 days.

(21) Appl. No.: 10/944,285

(22) Filed: Sep. 17, 2004

(65) Prior Publication Data

US 2005/0070433 A1 Mar. 31, 2005

(30) Foreign Application Priority Data

Sep. 25, 2003 (JP) ..... 2003-333393

(51) Int. Cl.
*B41M 5/40* (2006.01)

(52) U.S. Cl. ..... 428/195.1; 503/227

(58) Field of Classification Search ..... 428/195.1; 503/227

See application file for complete search history.

(56) References Cited

U.S. PATENT DOCUMENTS 5,217,773 A 6/1993 Yoshida
5,928,989 A * 7/1999 Ohnishi et al. ..... 503/227

FOREIGN PATENT DOCUMENTS

EP 0 642 927 A1 3/1995
EP 0 775 593 A1 5/1997

* cited by examiner

*Primary Examiner*—Bruce H. Hess
(74) *Attorney, Agent, or Firm*—Harness, Dickey & Pierce, P.L.C.

(57) ABSTRACT

There are provided a protective layer transfer sheet, which, upon transfer on an image formed by thermal transfer recording, provides a protective layer that can impart stampability and writability with a pen using an aqueous ink, a fountain pen or the like and, at the same time, is excellent in water resistance, solvent resistance and the like, and a print using the same. The protective layer transfer sheet comprises: a substrate sheet; and a thermally transferable protective layer provided on at least a part of one side of the substrate sheet, wherein the thermally transferable protective layer forms a protective layer having a water absorptive property upon thermal transfer and comprises at least a peel layer, a stampable and writable protective layer, and a heat-adhesive resin layer provided in that order as viewed from the substrate sheet side, the stampable and writable protective layer comprises water resistant micro-regions, which are resistant to water and porous, and water absorptive micro-regions formed of a water absorptive resin, and the mass ratio on a dry basis between constituents of the water resistant micro-regions and constituents of the water absorptive micro-regions is 0.1<constituent of water absorptive micro-regions/constituent of water resistant micro-regions<0.4.

4 Claims, 1 Drawing Sheet

PROTECTIVE LAYER TRANSFER SHEET AND PRINT

FIELD OF THE INVENTION

The present invention relates to a thermal transfer sheet, for a protective layer, with a protective layer separably provided thereon and a print using the same. More particularly, the present invention relates to a protective layer transfer sheet which can impart stampability and writability with a pen using an aqueous ink, a fountain pen or the like and, at the same time, excellent water resistance, solvent resistance, and chemical resistance, to an image formed by thermal transfer recording, and a print using the same.

BACKGROUND ART

At the present time, thermal transfer recording is widely used as a simple printing method. The thermal transfer recording can simply form various images and thus is utilized in printing wherein the number of prints may be relatively small, for example, in the preparation of ID cards, such as identification cards or photographs for business, or is utilized, for example, in printers of personal computers or video printers.

When a full-color gradational image such as a photograph-like image of a face is desired, the thermal transfer sheet used is such that, for example, colorant layers of yellow, magenta, and cyan and optionally black are provided as ink layers repeatedly in a large number in a face serial manner on a continuous substrate sheet.

Such thermal transfer sheets are classified roughly into thermal transfer sheets of the so-called "heat-fusion" or "thermal ink transfer" type wherein the colorant layer is melted and softened upon heating and as such is transferred onto an object, that is, an image-receiving sheet, and thermal transfer sheets of the so-called "sublimation dye transfer" or "thermal dye transfer" type wherein, upon heating, a dye contained in the colorant layer is sublimated to permit the dye to migrate onto the image-receiving sheet.

When the above thermal transfer sheet is used, for example, for preparing identification cards or documents, a method known for forming a protective layer on an image with a view to protecting the image is that a protective layer transfer sheet with a thermally transferable resin layer is stacked on an image formed by the thermal transfer of a heat-fusion colorant layer or thermally sublimable dye and the thermally transferable resin layer is transferred by means of a thermal head, a heating roll or the like to form a protective layer on the image.

The provision of the protective layer can improve abrasion resistance, chemical resistance, solvent resistance and the like of images, and, further, the addition of an ultraviolet absorber or the like to the protective layer can improve lightfastness of the images.

For example, Japanese Patent Laid-Open No. 240404/2002 discloses a thermal transfer sheet for a protective layer in which a thermally transferable protective layer is provided on at least a part of one side of a substrate sheet and the protective layer is a laminate having a structure of at least two layers, that is, comprises at least a layer composed mainly of an acrylic resin and a layer composed mainly of a polyester resin provided in that order on the substrate sheet.

The thermal transfer sheet for a protective layer disclosed in Japanese Patent Laid-Open No. 240404/2002, however, is disadvantageous in that when the formation of aqueous ink images, for example, stamps put at the joining of two leaves, or various stamp images, using an aqueous ink on a thermally transferred image, with a protective layer formed using the thermal transfer sheet for a protective layer, on a photographic paper is contemplated for use, e.g., in a photographic image of a face in a passport, the print cannot absorb and fix the aqueous ink.

To overcome the above problem, for example, Japanese Patent Laid-Open No. 324140/1996 discloses a thermal transfer film for a protective layer in which, for example, a water absorptive surface layer constituting the uppermost surface after transfer is a layer capable of absorbing and fixing an aqueous ink and the water absorptive surface layer is a substantially transparent porous layer or a partially water absorptive layer comprising at least water absorptive micro-regions and water resistant micro-regions.

In the thermal transfer film for a protective layer disclosed in Japanese Patent Laid-Open No. 324140/1996, however, the following facts should be noted. Specifically, when the water absorptive surface layer is a partially water absorptive layer comprising water absorptive micro-regions and water resistant micro-regions, the water absorptive layer is considered to have the so-called "islands-sea structure." When the proportion of the constituents of the water absorptive micro-regions to the constituents of the water resistant micro-regions exceeds a predetermined value, that is, when the proportion of the constituents of the water absorptive micro-regions increases, a part of the components constituting the water absorptive micro-regions, which are not resistant to water, is disadvantageously separated to form a layer which does not form an islands-sea structure. As a result, after the thermal transfer of the protective layer, when water penetrates into the protective layer and reaches the interface, a part of the protective layer is disadvantageously separated from the interfacial part.

Further, as the island-sea structure region constituted by the water resistant micro-regions and the water absorptive micro-regions is reduced, the speed of the penetration of water, from the surface of a print, at which water reaches the stampable and writable protective layer becomes so low that the drying speed of an aqueous stamp or ink becomes low and the stampability of the aqueous stamp and ink and writability are disadvantageously low.

DISCLOSURE OF THE INVENTION

An object of the present invention is to provide a protective layer transfer sheet, which, upon transfer on an image formed by thermal transfer recording, provides a protective layer that can impart stampability and writability with a pen using an aqueous ink, a fountain pen or the like and, at the same time, is excellent in water resistance, solvent resistance and the like, and a print using the same.

The above object can be attained by a protective layer transfer sheet comprising: a substrate sheet; and a thermally transferable protective layer provided on at least a part of one side of the substrate sheet, wherein said thermally transferable protective layer forms a protective layer having a water absorptive property upon thermal transfer and comprises at least a peel layer, a stampable and writable protective layer, and a heat-adhesive resin layer provided in that order as viewed from the substrate sheet side, said stampable and writable protective layer comprises water resistant micro-regions, which are resistant to water and porous, and water absorptive micro-regions formed of a water absorptive resin, and the mass ratio on a dry basis between constituents of the water resistant micro-regions and constituents of the water absorptive micro-regions is 0.1<constituents of water absorptive micro-regions/constituents of water resistant micro-regions<0.4.

The protective layer transfer sheet according to the present invention and at least one of a thermally sublimable colorant layer and a heat-fusion colorant layer may be provided in a face serial manner on an identical substrate film.

According to another aspect of the present invention, there is provided a print comprising a thermally transferred image covered with a protective layer which has been thermally transferred from any of the above protective layer transfer sheets.

A stamp can be affixed with an aqueous ink onto the thermally transferred protective layer in the print according to the present invention.

The present invention can provide a protective layer transfer sheet that, upon transfer onto an image formed by thermal transfer recording, can form a protective layer which can impart stampability with an aqueous ink and writability with a pen using an aqueous ink to a print originally having no aqueous ink fixation, and is excellent particularly in water resistance, solvent resistance, and chemical resistance, as well as in durability such as abrasion resistance and scratch resistance, and weathering resistance and transferability, and a print using the protective layer transfer sheet.

BEST MODE FOR CARRYING OUT THE INVENTION

The present invention will be described in more detail with reference to preferred embodiments.

Figure 1:
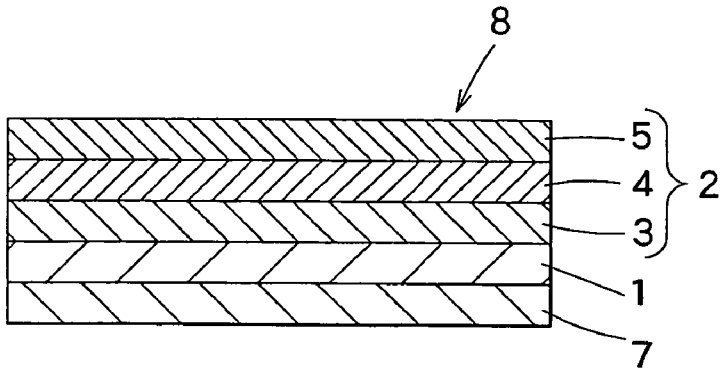
FIG. 1 is a cross-sectional view illustrating one embodiment of the protective layer transfer sheet according to the present invention.

FIG. 1 is a cross-sectional view illustrating one embodiment of a protective layer transfer sheet 8 according to the present invention. The protective layer transfer sheet 8 according to the present invention comprises a substrate sheet 1 and a thermally transferable protective layer 2 provided on one side of the substrate sheet 1. The thermally transferable protective layer 2 comprises a peel layer 3, a stampable and writable protective layer 4, and a heat-sensitive adhesive resin layer 5 provided in that order as viewed from the substrate sheet 1 side. The stampable and writable protective layer 4 comprises water resistant micro-regions, which is resistant to water and porous, and water absorptive micro-regions of a water absorptive resin.

In the protective layer transfer sheet 8 in this embodiment of the present invention, particularly the stampable and writable protective layer is such that the mass ratio on a dry basis between constituents of the water resistant micro-regions and constituents of the water absorptive micro-regions is 0.1<constituents of water absorptive micro-regions/constituents of water resistant micro-regions<0.4.

According to the protective layer transfer sheet 8 of the present invention, the thermally transferable protective layer 2 has excellent water resistance and solvent resistance, and upon transfer of the thermally transferable protective layer 2, the surface of a thermally transferred image comprising an image of a colorant can be covered with a protective layer to form a print which is stampable with an aqueous ink and, at the same time, is resistant to water, solvents, chemicals, and abrasion.

Further, the incorporation of an ultraviolet absorbing material in the thermally transferable protective layer 2 can prevent fading or discoloration of the image caused by ultraviolet light contained in sunlight or the like.

Furthermore, the provision of a heat resistant slip layer 7 on the protective layer transfer sheet on its side remote from the thermally transferable protective layer 2 can prevent the protective layer transfer sheet from sticking to a thermal head, a hot plate for transfer or the like of a printer and further can improve slipperiness.

Figure 2:
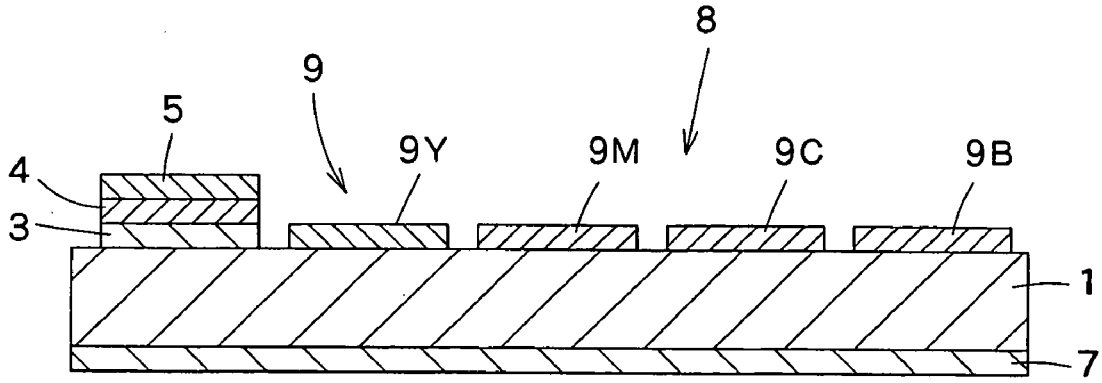
FIG. 2 is a schematic cross-sectional view showing another embodiment of the protective layer transfer sheet according to the present invention.

FIG. 2 is a schematic cross-sectional view showing another embodiment of the protective layer transfer sheet 8 according to the present invention. The protective layer transfer sheet 8 shown in FIG. 2 is a composite type protective layer transfer sheet. This transfer sheet comprises a substrate sheet 1 and, provided on one side of the substrate sheet 1 in the following order in a face serial manner, a thermally transferable protective layer 2 and thermally sublimable colorant layers 9 of hues of yellow, magenta, cyan, and black (9Y, 9M, 9C, and 9B). A heat resistant slip layer 7 is provided on the other side of the substrate sheet 1. The thermally transferable protective layer 2 comprises a peel layer 3, a stampable and writable protective layer 4, and a heat-sensitive adhesive resin layer 5 provided in that order as viewed from the substrate sheet 1 side. The stampable and writable protective layer 4 comprises water resistant micro-regions, which is resistant to water and porous, and water absorptive micro-regions of a water absorptive resin.

Further, as with the protective layer transfer sheet 8, a release layer may be provided on the substrate sheet 1 from the viewpoint of regulating the separability of the thermally transferable protective layer 2 from the substrate sheet 1.

The protective layer transfer sheet 8 according to the present invention is not limited to the above embodiments and may be, for example, a composite type protective layer transfer sheet comprising a thermally transferable protective layer and a heat-fusion colorant layer(s) and a composite type protective layer transfer sheet comprising a thermally transferable protective layer, a thermally sublimable colorant layer(s), and a heat-fusion colorant layer(s) that may be selected depending upon the purpose of use and the like.

In particular, when the thermal transfer sheet for a protective layer is the composite type thermal transfer sheet for a protective layer, image formation by thermal transfer and the transfer of a protective layer onto an object can be simultaneously carried out.

It should be noted that the drawings are provided for illustrative purposes only and are not intended to limit the invention in any way.

Each layer constituting the protective layer transfer sheet will be further described in more detail.

[Substrate Sheet]

In the protective layer transfer sheet of the present invention, any substrate sheet may be used as the substrate sheet 1 without particular limitation so far as the substrate sheet has film strength and heat resistance comparable to substrate sheets used in conventional thermal transfer sheets.

Specific examples of substrate sheets usable herein include films of plastics, for example, polyester resin films such as polyethylene terephthalate resin films, polycarbonate resin films, polyamide resin films, polyimide resin films, cellulose acetate resin films, polyvinylidene chloride resin films, polyvinyl chloride resin films, polystyrene resin films, fluororesin films, polypropylene resin films, polyethylene resin films, and ionomers. Further, for example, composite films or sheets formed by stacking two or more of the above films on top of each other or one another may also be used.

The thickness of the substrate sheet may be properly varied depending upon materials for the substrate sheet so that the substrate sheet has proper strength and heat resistance. In general, however, the thickness is preferably about 1 to 10 μm.

[Thermally Transferable Protective Layer]

The thermally transferable protective layer 2 according to the present invention is provided separably on at least a part of the substrate sheet, is stampable with an aqueous ink, is writable with a pen using an aqueous ink, and is further excellent in transferability, abrasion resistance, weathering resistance, chemical resistance, solvent resistance and the like.

The thermally transferable protective layer 2 comprises at least a peel layer 3, a stampable and writable protective layer 4, and a heat-sensitive adhesive resin layer 5 provided in that order. The stampable and writable protective layer 4 comprises water resistant micro-regions, which are resistant to water and porous, and water absorptive micro-regions of a water absorptive resin.

The whole thickness of the thermally transferable protective layer 2 is preferably in the range of about 1.0 to 5.0 μm from the viewpoint of excellent layer transferability, water absorption, durability, transparency and other properties.

When the whole thickness is less than 1.0 μm, durability such as abrasion resistance and water absorption are disadvantageously lowered, while, when the whole thickness is more than 5.0 μm, the transparency and the layer transferability are disadvantageously lowered.

[Peel Layer]

The peel layer 3 according to the present invention permits the thermally transferable protective layer 2 to be separated from the substrate sheet 1 and thermally transferred to an object. Upon the thermal transfer onto the object, the peel layer 3 constitutes the uppermost surface. Therefore, more preferably, the peel layer 3 has durability such as abrasion resistance, water resistance, weathering resistance, chemical resistance, and solvent resistance.

The peel layer 3 may be formed of a water resistant and porous layer to impart a water absorptive property and to penetrate an aqueous ink or the like into the stampable and writable protective layer 4 while regulating the water absorption of the aqueous ink or the like to some extent.

The water resistant and porous layer comprises a binder, fine particles, and a curing agent as indispensable ingredients, and, if necessary, a water dispersible polymer, a dispersant, an antioxidant, an antistatic agent and the like may be added thereto.

The water resistant and porous layer may be formed by dissolving or dispersing the ingredients such as the binder in a parent solvent such as water or an organic solvent to prepare a coating liquid, coating the coating liquid, and drying the coating.

In the formation of the peel layer 3, coating may be carried out by gravure coating, gravure reverse coating, roll coating, or other many coating methods using the above resin.

The coverage of the peel layer on a dry basis is preferably in the range of not less than 0.1 $g/m^2$ and not more than 1 $g/m^2$ from the viewpoint of excellent transferability and water absorption.

When the coverage is less than 0.1 $g/m^2$, durability such as abrasion resistance is disadvantageously lowered, while, when the coverage is more than 1 $g/m^2$, the transferability is disadvantageously deteriorated.

[Binder]

Any material may be used as the binder constituting the peel layer 3 according to the present invention without particular limitation so far as the material has properties required as the binder. When colloidal silica is used as the fine particles, however, the use of a water soluble resin as the binder is particularly preferred. Specific examples thereof include polyvinyl alcohol (PVA) resins, water soluble polyester resins, alkyl vinyl ether resins, maleic acid copolymer resins, polyvinyl pyrrolidone resins, cellulose resins, water-soluble alkyd resins, and non-cellulosic water-soluble polysaccharides. Among them, polyvinyl alcohol resins are particularly preferred.

Further, preferably, the same resin as that constituting the stampable and writable protective layer which will be described later is used, because the separation and transfer of the thermally transferable protective layer from the substrate sheet, the adhesion between the peel layer and the stampable and writable protective layer in the thermally transferable protective layer, and water absorption are excellent.

[Curing Agent]

Curing of the binder with the aid of a curing agent or the like can improve water resistance, solvent resistance, and chemical resistance of the porous layer.

The curing agent reactive with an active functional group in the water soluble resin used as the binder according to the present invention is used for imparting water resistance and solvent resistance according to the form of curing by the reaction between the active functional group and the curing agent and, further, for regulating the molecular weight of the water-soluble resin to improve layer transferability.

Curing agents usable herein include, for example, Sumirez Resin series manufactured by Sumitomo Chemical Co., Ltd. typified by Sumirez Resin 5004 which is a polyamide resin-type curing agent.

[Fine Particles]

Fine particles constituting the peel layer 3 according to the present invention are used for forming a porous layer by dispersing the fine particles in water or an organic solvent, coating the dispersion, and drying the coating.

The fine particles may be in any form, for example, in a spherical, acicular, or amorphous form. In particular, the use of spherical particles is more preferred, because the uniformity of particle diameters can be maximized, the porosity can be increased, and the water absorption can be improved.

When the shape of the fine particles is nonuniform, the porosity is lowered, disadvantageously resulting in lowered water absorption.

The average particle diameter of the fine particles is preferably not more than 0.3 μm from the viewpoint of maintaining the transparent property, and more preferably not more than 0.1 μm.

When the average particle diameter of the fine particles is more than 0.3 μm, disadvantageously, it is difficult to maintain the transparency.

The material for constituting the fine particles may be any of organic and inorganic materials so far as the material is transparent. Organic fine particles include, for example, acrylic fine particles, cellulosic fine particles, and non-cellulosic polysaccharide fine particles. Inorganic fine particles include, for example, fine particles of silica or its modified product, alumina sols, and fine particles of other metals and metal oxides.

In particular, colloidal silica is preferred, because it is in the form of fine particles that as such have high solvent resistance and have a hydrophilic group on their surface.

For example, Snowtex series manufactured by Nissan Chemical Industry Ltd. and Cataloid series manufactured by Catalysts and Chemicals Industries Co., Ltd. are preferred as the colloidal silica.

When the binder is a water soluble resin, the amount of the colloidal silica added preferably satisfies a mass ratio requirement represented by formula $1/30 \leqq$ water soluble resin/colloidal silica $\leqq 1/3$. When the mass ratio is in the above-defined range, the amount of water absorption caused by the penetration of an aqueous ink or the like into the stampable and writable protective layer can be regulated to some extent and, at the same time, durability such as abrasion resistance can also be provided.

When the mass ratio is less than 1/30, the effect as the binder is disadvantageously unsatisfactory. On the other hand, when the mass ratio is more than 1/3, any porous structure cannot be formed and, consequently, the water absorption is disadvantageously lowered.

[Water Dispersible Polymer]

The water dispersible polymer is added to the peel layer 3 according to the present invention to improve the capability of holding the thermally transferable protective layer on the substrate sheet.

Specifically, for example, a polymeric material comprising at least one of polyester resins, polyurethane resins, polyacrylic resins, vinylidene chloride resins and the like may be used, and the selection of a resin having a good capability of holding the thermally transferable protective layer on the substrate sheet in corporation with the resin component in the substrate sheet is preferred.

The water dispersible polymer used in the present invention is a polymer which is soluble, emulsifiable or dispersible in water.

A preferred water dispersible polyester resin is, for example, Vylonal manufactured by Toyobo Co., Ltd.

[Stampable and Writable Protective Layer]

The stampable and writable protective layer 4 according to the present invention should be a layer having a water absorptive property.

In particular, the stampable and writable protective layer 4 according to the present invention comprises water resistant micro-regions, which are resistant to water and porous, and water absorptive micro-regions formed of a water absorptive resin, and the mass ratio on a dry basis between constituents of the water resistant micro-regions and constituents of the water absorptive micro-regions is 0.1<constituents of water absorptive micro-regions/constituents of water resistant micro-regions<0.4. When this requirement is satisfied, after the transfer of the thermally transferable protective layer 2, the protective layer formed by the transfer can advantageously impart properties such as water resistance, solvent resistance, and chemical resistance without causing delamination.

On the other hand, when the mass ratio on a solid basis between the constituents of the water absorptive micro-regions and the constituents of the water resistant micro-regions is not more than 0.1, disadvantageously satisfactory water absorption cannot be provided because of a reduction in the water absorbing part in the stampable and writable protective layer. On the other hand, when this mass ratio is not less than 0.4, a part of the material of the water absorptive micro-regions is disadvantageously separated from the water resistant micro-regions at the interface of the peel layer and the stampable and writable protective layer. Therefore, in this case, after the transfer of the thermally transferable protective layer 2 onto an image, the penetration of water disadvantageously causes separation of the above part from the layer of the water absorptive resin.

[Constituents of Water Absorptive Micro-regions]

In the stampable and writable protective layer 4 according to the present invention, the constituents of the water absorptive micro-regions may be any materials without particular limitation so far as they have a water absorptive property. Specific examples thereof include water absorptive resins, for example, acrylic polyol resins, urethane polyol resins, cellulosic resins such as methylcellulose, carboxymethylcellulose, and hydroxyethylcellulose, synthetic polymers such as polyvinyl pyrrolidone resins, alkyl vinyl ethers, polymaleic acid copolymer resins, water-soluble polyester resins, and polyvinyl alcohol resins, inorganic polymers such as sodium polyphosphates, seaweed extracts such as agars and sodium alginate, plant viscous materials such as gum arabic and hibiscus, animal proteins such as caseins and gelatins, fermentation viscous materials such as pullulans and dextrans, starches, and starchy materials.

The coverage of the coating liquid comprising the water absorptive resin is preferably in the range of not less than 0.1 $g/m^2$ and not more than 2 $g/m^2$ on a solid basis.

[Constituents of Water Resistant Micro-regions]

The constituents of water resistant micro-regions according to the present invention, together with the water absorptive resin, function to hold an aqueous ink or the like being passed through the peel layer 3 and penetrated into the stampable and writable protective layer 4.

The constituents constituting the water resistant micro-regions may be the same as the materials for the formation of water resistant porosity used in the peel layer 3. Specifically, the water resistant micro-regions may comprise a binder, fine particles, a curing agent as indispensable constituents and optionally a dispersant, and the fine particles may be of the same shape as the fine particles as described above and may be added in the same amount as the fine particles as described above.

The coverage of the coating liquid for the formation of water resistant porosity is preferably not less than 1 $g/m^2$ and not more than 5 $g/m^2$ on a solid basis.

Regarding the method for coating the coating liquid for water resistant micro-region formation, a binder and a curing agent are dissolved in and mixed together with a parent solvent (water, an organic solvent or the like), and the resultant coating liquid is coated followed by drying to form water resistant micro-regions.

In the formation of the porous layer, gravure coating, gravure reverse coating, roll coating, and other many coating methods may be used.

[Binder]

A water-soluble resin is used as the binder constituting the water resistant micro-regions according to the present invention, and a curing agent should further be added to impart water resistance and solvent resistance.

Among others, the use of a polyvinyl alcohol resin as the binder and the use of, for example, a polyamide resin as the curing agent are preferred from the viewpoint of improved suitability for stamping.

[Curing Agent]

In the material constituting the water-resistant micro-regions according to the present invention, the curing agent reactive with an active functional group in the water soluble resin is used for imparting water resistance and solvent resistance according to the form of curing by the reaction between the active functional group and the curing agent and, further, for regulating the molecular weight of the water-soluble resin to improve layer transferability.

Curing agents usable herein include, for example, Sumirez Resin series manufactured by Sumitomo Chemical Co., Ltd. typified by Sumirez Resin 5004 which is a polyamide resin-type curing agent.

From the viewpoints of excellent water resistance, solvent resistance, and layer transferability, the mixing ratio between the binder to the curing agent is preferably such that the ratio of the equivalent of the reactive group in the curing agent to the equivalent of the active group in the water soluble resin, the ratio on a solid basis of the weight of the curing agent added to the weight of the water soluble resin added, is 0.05%≦curing agent/water-soluble resin≦2%.

[Ultraviolet Screening Layer]

In the present invention, in order to suppress fading or discoloration of an image, formed in a print on which a protective layer is to be transferred, caused by ultraviolet light contained in sunlight and the like, an ultraviolet screening layer is preferably provided on the thermally transferable protective layer.

The ultraviolet screening layer is formed by coating an ink comprising a resin with an ultraviolet absorber incorporated therein to form a film.

Ultraviolet absorbers usable herein include organic ultraviolet absorbers, such as benzophenone compounds, benzotriazole compounds, oxalic anilide compounds, cyanoacrylate compounds, and salicylate compounds. Inorganic fine particles having an ultraviolet absorbing capacity such as oxides of zinc, titanium, cerium, tin, iron and the like may also be added to the resin.

The resin used is not particularly limited, and any resin may be used. Examples of resins usable herein include acrylic resins, polyester resins, urethane resins, styrene resins, halogenated vinyl resins, vinyl acetate resins, polycarbonate resins, phenolic resins, melamine resins, epoxy resins, cellulose resins, hydrocarbon resins such as polyethylene, vinyl resins such as polyvinyl alcohol and polyvinyl pyrrolidone, and copolymers thereof. Alternatively, a method may also be adopted in which the ultraviolet screening layer is not additionally provided and the ultraviolet absorber is added to the water absorptive surface layer or the heat-sensitive adhesive resin layer.

Further, a method may also be adopted in which a reactive ultraviolet absorber is reacted with and bonded to the resin and this treated resin is added solely or as a mixture to the peel layer 3, the stampable and writable protective layer 4 and/or the heat-sensitive adhesive resin layer 5 or is provided as an ultraviolet screening layer.

The reactive ultraviolet absorber may be reacted with and fixed to the resin by various methods. For example, a copolymer may be prepared by radically polymerizing a conventional monomer, oligomer, or a reactive polymer as a resin component with the above-described reactive ultraviolet absorber having an addition-polymerizable double bond.

When the reactive ultraviolet absorber contains, for example, a hydroxyl, amino, carboxyl, epoxy, or isocyanate group, a method may be used in which a thermoplastic resin having a group reactive with the above functional group is used and the reactive ultraviolet absorber is reacted with and fixed to the thermoplastic resin by heat or the like optionally in the presence of a catalyst. Monomer components copolymerizable with the reactive ultraviolet absorber include, for example, methyl (meth)acrylate, ethyl (meth)acrylate, propyl (meth)acrylate, butyl (meth)acrylate, isobutyl (meth) acrylate, tert-butyl (meth)acrylate, isodecyl (meth)acrylate, lauryl (meth)acrylate, lauryltridecyl (meth)acrylate, tridecyl (meth)acrylate, cetylstearyl (meth)acrylate, stearyl (meth) acrylate, ethylhexyl (meth)acrylate, octyl (meth)acrylate, cyclohexyl (meth)acrylate, benzyl (meth)acrylate, methacrylic acid, hydroxyethyl (meth)acrylate, hydroxypropyl (meth)acrylate, dimethylaminoethyl (meth)acrylate, diethylaminoethyl (meth)acrylate, tert-butylaminoethyl (meth) acrylate, glycidyl (meth)acrylate, tetrahydrofurfuryl (meth) acrylate, ethylene di(meth)acrylate, diethylene glycol (meth) acrylate, triethylene glycol di(meth)acrylate, tetraethylene glycol di(meth)acrylate, decaethylene glycol (meth)acrylate, pentadecaethylene (meth)acrylate, pentacontahectaethylene glycol (meth)acrylate, butylene di(meth)acrylate, aryl (meth)acrylate, trimethylolpropane (meth)acrylate, hexanediol di(meth)acrylate, tripropylene glycol dimethacrylate, pentaerythritol tetra(meth)acrylate, pentaerythritonyl hexa(meth)acrylate, 1,6-hexanediol di(meth)acrylate, neopentylglycol penta(meth)acrylate, and phosphazene hexa (meth)acrylate.

The above materials may be used not only as monomers but also as oligomers. Further, polyester acrylate, epoxyacrylate or other acrylic reactive polymers comprising polymers of the above materials or derivatives thereof may also be used. These monomers, oligomers, and acrylic reactive polymers may be used either solely or as a mixture of two or more.

A thermoplastic copolymer resin with a reactive ultraviolet absorber reacted and fixed thereto is produced by copolymerizing the monomer, oligomer or acrylic reactive polymer of the thermoplastic resin with the reactive ultraviolet absorber. The copolymer resin preferably contains 10 to 90% by weight, preferably 30 to 70% by weight, of the reactive ultraviolet absorber. When the reactive ultraviolet absorber content is below the lower limit of the above defined content range, satisfactory lightfastness cannot be provided without difficulties. On the other hand, when the reactive ultraviolet absorber content is above the upper limit of the above defined content range, problems disadvantageously occur such as tackiness at the time of coating and bleeding of a dye image upon the adhesion of the ultraviolet screening layer to the image.

The molecular weight of the copolymer resin is preferably about 5,000 to 50,000, more preferably about 9,000 to 40,000. When the molecular weight is less than 5000, the film strength is so low that the roughness is unsatisfactory for the protective layer.

On the other hand, when the molecular weight of the copolymer resin exceeds 50000, the viscosity is increased, disadvantageously rendering handling troublesome. Further, in this case, disadvantageously, layer transferability is adversely affected.

The ultraviolet screening layer according to the present invention may be formed of a resin with the reactive ultraviolet absorber being reacted therewith and bonded thereto. This layer may consist of this resin alone or, if necessary, may be formed of a mixture of this resin with other resin.

The ultraviolet screening layer may be formed on the stampable and writable protective layer 4. In this case, the adhesion between the ultraviolet screening layer and the stampable and writable protective layer 4 is poor, a primer layer may be formed.

Resins usable for the formation of the primer layer include urethane resins, polyester resins, polypropylene resins, polyol resins, and products of reactions between these resins and isocyanates.

Isocyanates usable herein include diisocyanate compounds and triisocyanate compounds.

The thickness of the primer layer is preferably in the range of 0.1 to 10 μm.

The ultraviolet screening layer is preferably provided between the stampable and writable protective layer 4 and the heat-sensitive adhesive resin layer 5. The ultraviolet screening layer may be formed by the same method as used in the formation of the water absorptive layer, and the thickness thereof is preferably about 0.1 to 5 μm.

[Heat-sensitive Adhesive Resin Layer]

In the present invention, the heat-sensitive adhesive resin layer 5 constituting the thermally transferable protective layer 2 is formed to realize good adhesion between the protective layer formed by the transfer of the thermally transferable protective layer 2 and the printed face upon the transfer of the thermally transferable protective layer 2 onto the printed face.

Resins usable for the heat-sensitive adhesive resin layer 5 include, for example, acrylic resins, vinyl chloride resins, vinyl acetate resins, vinyl chloride-vinyl acetate copolymer resins, styrene-acryl copolymer resins, polyester resins, and polyamide resins.

The heat-sensitive adhesive resin layer may be formed by brining one or at least two of these resins to a coatable form such as a solution or emulsion, coating the coating liquid by any suitable coating method described above in connection with the transparent resin layer, and drying the coating.

The thickness of the heat-sensitive adhesive resin layer 5 is preferably about 0.1 to 5 μm.

The heat-sensitive adhesive resin layer 5 may comprise the above resin and additives, for example, organic ultraviolet absorbers such as benzophenone compounds, benzotriazole compounds, oxalic anilide compounds, cyanoacrylate compounds, and salicylate compounds, or inorganic fine particles having ultraviolet absorption capacity, such as oxides of zinc, titanium, cerium, tin, iron or the like. Further, if necessary, color pigments, white pigments, extender pigments, fillers, antistatic agents, antioxidants, fluorescent brighteners and the like may also be properly used as additives.

An adhesive layer preferably having a thickness of about 0.5 to 10 μm on a dry basis is formed by coating a coating liquid containing the above resin for constituting the adhesive layer and optionally the above additives and then drying the coating.

[Heat Resistant Slip Layer]

Further, in the protective layer transfer sheet according to the present invention, as shown in FIG. 3, if necessary, a heat resistant slip layer 7 may be provided on the heat resistant substrate sheet 1 in its side remote from the thermally transferable protective layer 2 from the viewpoints of preventing sticking to a thermal head of a printer, a hot plate for transfer or the like and improving the slip properties.

A conventional resin, such as a resin prepared by curing a butyral resin or the like with an isocyanate compound or a silicone resin, as such may be used for constituting the heat resistant slip layer 7. The thickness of the heat resistant slip layer may be about 0.1 to 5 μm.

The heat resistant slip layer 7 may if necessary be provided through a primer layer.

Next, in the present invention, the thermally transferable protective layer 2 may be provided solely on the substrate sheet 1 to form a transfer film for a thermally transferable protective layer 2 only. Alternatively, for example, thermal transfer ink layers, such as thermally sublimable dye ink layers of yellow, magenta, and cyan or a heat-fusion type transfer ink layer of black (containing carbon black), may be arranged in a face serial manner on an identical substrate to form an integral thermal transfer sheet comprising thermal transfer ink layers and a thermally transferable protective layer 2 arranged in a face serial manner on an identical substrate.

In the case of the integral transfer film, the plate pattern is not particularly limited. For example, a transfer film with the following layer patterns being repeatedly provided in a face serial manner may be mentioned (In the following description, for colors, yellow is referred to as "Ye", magenta as "Mg", cyan as "Cy", and black as "Bk"): (1) Ye dye layer, Mg dye layer, Cy dye layer, and thermally transferable protective layer, (2) Ye dye layer, Mg dye layer, Cy dye layer, Bk dye layer, and thermally transferable protective layer, (3) Ye dye layer, Mg dye layer, Cy dye layer, Bk heat-fusion ink layer, and thermally transferable protective layer, (4) Bk dye layer and thermally transferable protective layer, and (5) Bk heat-fusion ink layer and thermally transferable protective layer. In these plate patterns, the size of the Bk dye layer, the Bk heat-fusion ink layer, and the thermally transferable protective layer may be larger than the other layers.

A detection mark for detecting each layer may be provided anywhere in each layer. For example, it may be provided at the head of each layer area or at the head in the color in the front position.

In the integral transfer sheet comprising ink layers and a thermally transferable protective layer arranged in a face serial manner on an identical substrate, registration in these predetermined patterns followed by overprinting is necessary. In this case, an additive, such as a fluorescent brightener, may be incorporated into each layer to permit the registration to be easily performed visually or in a mechanical detection manner upon ultraviolet irradiation or the like.

Regarding the thermal transfer ink layers, inks and methods for the conventional thermal transfer sheet as such may be used for the material of the ink used, the method for providing the ink on the surface of the substrate sheet and the like.

Images to be protected by using the thermal transfer film for a protective layer are usually those formed by the thermal dye transfer method and/or the heat-fusion ink transfer method. In particular, when the thermal transfer film for a protective layer is applied to an image formed by the thermal dye transfer, a protective layer is formed on the image and, at the same time, the dye constituting the image is again subjected to color development by heat applied at the time of transfer, offering the effect of rendering the image clearer.

The thermal dye transferred image and/or the heat-fusion thermal transferred image is formed by using a thermal transfer sheet having a thermally sublimable ink layer, a thermal transfer sheet having a heat-fusion ink layer, or the protective layer transfer sheet according to the present invention onto an image-receiving sheet or a card substrate comprising a plastic sheet substrate of a polyester resin, a vinyl chloride resin, a vinyl chloride/vinyl acetate copolymer resin, a polycarbonate or the like, a thermal transfer image-receiving sheet comprising a dye-receptive resin layer (a receptive layer) on a substrate sheet described below, or a film, a sheet, or a molded product of the above resin to form a thermally transferred image record for constituting the print of the present invention.

Dye-receptive resins usable herein include polyolefin resins, such as polypropylene; halogenated resins, such as polyvinyl chloride and polyvinylidene chloride; vinyl resins, such as polyvinyl acetate and various polyacrylates; polyester resins, such as polyethylene terephthalate and polybutylene terephthalate; polystyrene resins, such as polystyrene or copolymers thereof; polyamide resins; resins of copolymers of olefins, such as ethylene or propylene with other vinyl monomers; ionomers; cellulosic resins, such as cellulose diacetate, and cellulose triacetate; and polycarbonates. A release agent, such as a silicone oil, may be incorporated into the resin layer in order to prevent the resin layer from fusing to the thermal transfer sheet for a protective layer.

The receptive layer may be formed by a coating method or by thermal transfer using a thermal head, a hot roll or the like.

When the sheet substrate per se is receptive to a dye, there is no need to provide the receptive layer.

Sheet substrates usable in the thermal transfer image-receiving sheet include synthetic papers (polyolefin, polystyrene or other types of synthetic papers), wood free paper, art paper, coat paper, cast coated paper, wall paper, backing paper, paper impregnated with a synthetic resin solution or an emulsion, paper impregnated with a synthetic rubber latex, paper with a synthetic resin being internally added thereto, paperboard, and natural fiber papers such as cellulose fiber papers, and films of polyolefin, polyvinyl chloride, polyethylene terephthalate, polystyrene, polymethyl methacrylate, and polycarbonate. They may be used in a single-layer or multilayer structure.

[Card Substrate]

Next, materials for cards as an object, on which an image is to be formed, will be described.

The card substrate used in the present invention comprises a resin dyeable with a thermally sublimable dye.

For example, polyolefine, polyvinyl chloride, polyethylene terephthalate, polystyrene, polymethacrylate, and polycarbonate films may be used.

Further, for example, white opaque films or sheets formed from a synthetic resin with a white pigment or a filler added thereto, or a foamed sheet; and synthetic papers (polyolefin, polystyrene or other types of synthetic papers) as such may be used. If necessary, a dye-receptive layer may be formed thereon.

Further, for example, wood free paper, art paper, coat paper, cast coated paper, wall paper, backing paper, paper impregnated with a synthetic resin solution or emulsion, paper impregnated with a synthetic rubber latex, paper with a synthetic resin being internally added thereto, paperboard, and cellulose fiber paper, each having a dye-receptive layer, may also be used. Laminates of any combination of the above plastic films may also be used.

One example of preferred card substrates according to the present invention has such a construction that a transparent polyvinyl chloride layer is laminated on both sides of a center layer of a polyvinyl chloride sheet containing a white pigment with a suitable amount of a plasticizer incorporated into at least the transparent vinyl chloride layer as an image forming face to improve the dyeability of the layer with the dye.

Further, coloring pigments, white pigments, extender pigments, fillers, ultraviolet absorbers, antistatic agents, thermal stabilizers, antioxidants, fluorescent brighteners and the like may be optionally used on the dye receiving face of the print.

Further, a desired magnetic recording layer, emboss pattern or other print pattern, an optical memory, an IC memory, a bar code and the like may be previously formed on the card substrate for a print. Further, the magnetic recording layer or the like may be provided before or after the formation of information on a photograph of a face or the like by the thermal dye transfer system or the like.

Furthermore, an emboss pattern, a signature, an IC memory, a magnetic layer, a hologram, or other print may also be provided on the card. The emboss pattern, signature, magnetic layer or the like may be provided after the transfer of the thermally transferable protective layer. The photograph-like image of a face may be provided on the card substrate by using the thermal dye transfer sheet according to the present invention.

At the same time, information on letters, bar codes and the like may be formed by using the thermal dye transfer sheet. Preferably, the above information is formed using a heat-fusion ink type thermal transfer sheet which enables high-density black printing.

A color image and/or a letter image are formed on an image-receiving sheet, a card or the like by using a thermal transfer sheet by means of a thermal printer, and a thermally transferable protective layer is transferred thereon using the protective layer transfer sheet 8 according to the present invention to form a protective layer. Alternatively, the protective layer transfer sheet according to the present invention, having a thermal transfer ink layer may be used.

In the transfer, separate thermal printers may be used under separate conditions for the thermal dye transfer, the heat-fusion transfer, and the transfer of the protective layer. Alternatively, a single printer may be used while properly regulating printing energy for each of transfer operation.

In the thermal transfer film for a protective layer according to the present invention, heating means is not limited to the thermal printer, and other heating means, such as a hot plate, a hot stamper, a hot roll, a line heater, and an iron may also be used.

The thermally transferable protective layer may be transferred on the whole surface of the formed image or on a desired area of the image.

The protective layer transfer sheet according to the present invention can be used for thermal transfer to prepare cards such as identification (ID) cards, various certificates, and license, can realize stamping with an aqueous ink or writing with a pen using an aqueous ink on a thermally transferred image record originally having no aqueous ink fixation, and is advantageous in that the thermally transferable protective layer is excellent particularly in water resistance, solvent resistance, and chemical resistance, as well as in durability such as abrasion resistance and scratch resistance, and weathering resistance and transferability.

The following Examples and Comparative Examples further illustrate the present invention.

EXAMPLE 1

A 5.2 μm-thick polyethylene terephthalate (PET) film was provided as a substrate sheet. A coating liquid for a heat resistant slip layer comprising a silicone resin was gravure coated on one side of the substrate sheet at a coverage of 0.7 $g/m^2$ on a dry basis to form a heat resistant slip layer. A coating liquid for a peel layer having the following composition was coated on the other side of the substrate sheet at a coverage of 0.5 g/m$^2$ on a dry basis, and the coating was dried to form a peel layer. Further, constituents of water resistant micro-regions were gravure coated using a coating liquid for water resistant micro-region formation having the following composition on the peel layer at a coverage of 3.0 g/m$^2$ on a dry basis, and the coating was dried. Constituents of water absorptive micro-regions were then gravure coated thereon using a coating liquid for water absorptive micro-region formation having the following composition at a coverage of 0.5 g/m$^2$ on a dry basis. As a result, a stampable and writable protective layer having a mass ratio on a dry basis between the constituents of the water resistant micro-regions and the constituents of the water absorptive micro-regions (constituents of water absorptive micro-regions/constituents of water resistant micro-regions) of 0.17 was formed.

Further, a coating liquid for a heat-sensitive adhesive resin layer having the following composition was gravure coated on the stampable and writable protective layer at a coverage of 1.0 to 1.5 g/m$^2$ on a dry basis, and the coating was dried to form a heat-sensitive adhesive resin layer. Thus, a protective layer transfer sheet of Example 1 according to the present invention having a layer construction of heat-sensitive adhesive resin layer 5/stampable and writable protective layer (comprising water resistant micro-regions and water absorptive micro-regions) 4/peel layer 3/substrate sheet 1/heat resistant slip layer 7 was prepared.

| [Composition of coating liquid for peel layer] | |
|---|---|
| Polyvinyl alcohol resin (C318, manufactured by Kuraray Co., Ltd.; number average molecular weight: about 80,000) | 1.08 pts. wt. |
| Colloidal silica dispersion (Snowtex OL-40, manufactured by Nissan Chemical Industry Ltd.; average particle diameter: about 20 nm) | 7.5 pts. wt. |
| Water-dispersed polyester resin (Vylonal MD-1500, manufactured by Toyobo Co., Ltd.) | 0.2 pt. wt. |
| Curing agent (Sumirez Resin 5004, manufactured by Sumitomo Chemical Co., Ltd.) | 0.045 pt. wt. |
| Isopropyl alcohol | 18 pts. wt. |
| Water | 5 pts. wt. |
| [Composition of coating liquid for water resistant micro-region formation] | |
| Polyvinyl alcohol resin (C318, manufactured by Kuraray Co., Ltd.; number average molecular weight: about 80,000) | 0.24 pt. wt. |
| Colloidal silica dispersion (Snowtex OL-40, manufactured by Nissan Chemical Industry Ltd.; average particle diameter: about 20 nm) | 8 pts. wt. |
| Curing agent (Sumirez Resin 5004, manufactured by Sumitomo Chemical Co., Ltd.) | 0.1 pt. wt. |
| Isopropyl alcohol | 3 pts. wt. |
| Water | 1 pt. wt. |
| [Composition of coating liquid for water absorptive micro-region formation] | |
| Polyvinyl pyrrolidone resin (PVP K-90, manufactured by ISP Japan Ltd.; weight average molecular weight: about 900,000 to 1,500,000) | 4 pts. wt. |
| Acrylic polyol (Dianal LR 209, manufactured by Mitsubishi Rayon Co., Ltd.) | 10 pts. wt. |
| Urethane polyol (SANPRENE IB114, manufactured by Sanyo Chemical Industries. Ltd.) | 3 pts. wt. |
| Methyl ethyl ketone | 40 pts. wt. |
| Isopropyl alcohol | 25 pts. wt. |
| [Composition of coating liquid for heat-sensitive adhesive resin layer] | |
| Polyester resin (Vylon 700, manufactured by Toyobo Co., Ltd.) | 8 pts. wt. |

-continued

| | |
|---|---|
| Acrylic resin (PUVA 50 M, manufactured by Otsuka Chemical Co., Ltd.) | 2 pts. wt. |
| Ultraviolet absorber (Tinuvin 900, manufactured by Ciba Specialty Chemicals, K.K.) | 1 pt. wt. |
| Methyl ethyl ketone | 40 pts. wt. |
| Toluene | 40 pts. wt. |

Next, a thermal dye transfer-type thermal transfer sheet for a thermal dye transfer printer manufactured by Mitsubishi Electric Corporation (MITUBISHI CP710) and an overcoat-type thermal transfer image-receiving sheet for the same printer were provided. The thermal transfer image-receiving sheet and the thermal dye transfer-type thermal transfer sheet were put on top of each other so that the receptive layer in the thermal transfer image-receiving sheet came into contact with the dye layer face of the thermal dye transfer-type thermal transfer sheet. 10 thermally transferred image recorded sheets of a black solid image were continuously formed with a thermal dye transfer printer manufactured by Mitsubishi Electric Corporation (MITUBISHI CP710) under an environment temperature of 45° C.

The thermal transfer image-receiving sheet used was prepared by providing a synthetic paper (Yupo FRG-150, thickness 150 microns; manufactured by Oji-Yuka Synthetic Paper Co., Ltd.) as a substrate sheet, bar-coating a coating liquid for a dye-receptive layer having the following composition onto one side of the substrate sheet at a coverage of 4 g/m$^2$ on a dry basis, and then drying the coating to form a dye-receptive layer.

| [Coating liquid for dye-receptive layer formation] | |
|---|---|
| Vinyl chloride-vinyl acetate copolymer (Denka Vinyl 1000A, manufactured by Denki Kagaku Kogyo K.K.) | 20 pts. wt. |
| Epoxy-modified silicone oil (X-22-2900T, manufactured by The Shin-Etsu Chemical Co., Ltd.) | 1 pt. wt. |
| Methyl ethyl ketone | 40 pts. wt. |
| Toluene | 40 pts. wt. |

A protective layer transfer sheet of Example 1 prepared above was put on top of the black solid image formed by the above method, and the thermally transferable protective layer was transferred from the protective layer transfer sheet by the same printer as used in the formation of the black solid image to form a black solid image with a protective layer.

As a result, the protective layer transfer sheet of Example 1 could provide a print with a protective layer that was stampable with an aqueous ink, was writable with a pen using an aqueous ink, did not cause the separation of the thermally transferred protective layer upon the penetration of water, organic solvents, chemicals or the like into the thermally transferred protective layer, that is, had excellent water resistance, solvent resistance, and chemical resistance, and, at the same time, had transparency, fastness properties such as abrasion resistance and scratch resistance, weathering resistance and other properties.

EXAMPLE 2

A protective layer transfer sheet of Example 2 was prepared in the same manner as in Example 1, except that, in the formation of the stampable and writable protective layer of Example 1, the coverage on a dry basis of the coating liquid for water resistant micro-region formation was changed to 2.0 g/m$^2$ and the coverage on a dry basis of the coating liquid for water absorptive micro-region formation was changed to 0.5 g/m$^2$.

The stampable and writable protective layer of Example 2 thus formed had a mass ratio between constituents of the water resistant micro-regions and constituents of water absorptive micro-regions (constituents of water absorptive micro-regions/constituents of water resistant micro-regions) of 0.25 on a dry basis.

The protective layer transfer sheet of Example 2 prepared above was put on top of a black solid image formed in the same manner as in Example 1, and the thermally transferable protective layer was transferred by the same printer as used in the formation of the black solid image to form a black solid image with a protective layer.

As a result, the protective layer transfer sheet of Example 2 could provide a print with a protective layer that was stampable with an aqueous ink, was writable with a pen using an aqueous ink, did not cause the separation of the thermally transferred protective layer upon the penetration of water, organic solvents, chemicals or the like into the thermally transferred protective layer, that is, had excellent water resistance, solvent resistance, and chemical resistance, and, at the same time, had transparency, fastness properties such as abrasion resistance and scratch resistance, weathering resistance and other properties.

EXAMPLE 3

A protective layer transfer sheet of Example 3 was prepared in the same manner as in Example 1, except that, in the formation of the stampable and writable protective layer of Example 1, the coverage on a dry basis of the coating liquid for water resistant micro-region formation was changed to 1.5 g/m$^2$ and the coverage on a dry basis of the coating liquid for water absorptive micro-region formation was changed to 0.5 g/m$^2$.

The stampable and writable protective layer of Example 3 thus formed had a mass ratio between constituents of the water resistant micro-regions and constituents of water absorptive micro-regions (constituents of water absorptive micro-regions/constituents of water resistant micro-regions) of 0.33 on a dry basis.

The protective layer transfer sheet of Example 3 prepared above was put on top of a black solid image formed in the same manner as in Example 1, and the thermally transferable protective layer was transferred by the same printer as used in the formation of the black solid image to form a black solid image with a protective layer.

As a result, the protective layer transfer sheet of Example 3 could provide a print with a protective layer that was stampable with an aqueous ink, was writable with a pen using an aqueous ink, did not cause the separation of the thermally transferred protective layer upon the penetration of water, organic solvents, chemicals or the like into the thermally transferred protective layer, that is, had excellent water resistance, solvent resistance, and chemical resistance, and, at the same time, had transparency, fastness properties such as abrasion resistance and scratch resistance, weathering resistance and other properties.

COMPARATIVE EXAMPLE 1

A protective layer transfer sheet of Comparative Example 1 was prepared in the same manner as in Example 1, except that, in the formation of the stampable and writable protective layer of Example 1, the coverage on a dry basis of the coating liquid for water resistant micro-region formation was changed to 1.5 g/m$^2$ and the coverage on a dry basis of the coating liquid for water absorptive micro-region formation was changed to 0.6 g/m$^2$.

The stampable and writable protective layer of Comparative Example 1 thus formed had a mass ratio between constituents of the water resistant micro-regions and constituents of water absorptive micro-regions (constituents of water absorptive micro-regions/constituents of water resistant micro-regions) of 0.40 on a dry basis.

The protective layer transfer sheet of Comparative Example 1 prepared above was put on top of a black solid image formed in the same manner as in Example 1, and the thermally transferable protective layer was transferred by the same printer as used in the formation of the black solid image to form a black solid image with a protective layer.

In the print with a protective layer prepared in Comparative Example 1, upon penetration of an aqueous ink into the thermally transferred protective layer, a part of the material of the water absorptive micro-regions was disadvantageously separated from the water resistant micro-regions to form a layer of the water absorptive resin at the interface of the peel layer and the stampable and writable protective layer. As a result, after the transfer of the thermally transferable protective layer 2 onto the image, upon the penetration of water into the thermally transferred protective layer, separation disadvantageously occurred at the layer of the water absorptive resin, and the print with a protective layer had poor water resistance, solvent resistance, and chemical resistance.

COMPARATIVE EXAMPLE 2

A protective layer transfer sheet of Comparative Example 2 was prepared in the same manner as in Example 1, except that, in the formation of the stampable and writable protective layer of Example 1, the coverage on a dry basis of the coating liquid for water resistant micro-region formation was changed to 1.5 g/m$^2$ and the coverage on a dry basis of the coating liquid for water absorptive micro-region formation was changed to 1.0 g/m$^2$.

The stampable and writable protective layer of Comparative Example 2 thus formed had a mass ratio between constituents of the water resistant micro-regions and constituents of water absorptive micro-regions (constituents of water absorptive micro-regions/constituents of water resistant micro-regions) of 0.67 on a dry basis.

The protective layer transfer sheet of Comparative Example 2 prepared above was put on top of a black solid image formed in the same manner as in Example 1, and the thermally transferable protective layer was transferred by the same printer as used in the formation of the black solid image to form a black solid image with a protective layer.

In the print with a protective layer prepared in Comparative Example 2, upon penetration of an aqueous ink into the thermally transferred protective layer, a part of the material of the water absorptive micro-regions was disadvantageously separated from the water resistant micro-regions to form a layer consisting of the water absorptive resin alone at the interface of the peel layer and the stampable and writable protective layer. As a result, after the transfer of the thermally transferable protective layer 2 onto the image, upon the penetration of water into the print, separation disadvantageously occurred at the layer consisting of the water absorptive resin alone, and the print with a protective layer had poor water resistance, solvent resistance, and chemical resistance.

COMPARATIVE EXAMPLE 3

A protective layer transfer sheet of Comparative Example 3 was prepared in the same manner as in Example 1, except that, in the formation of the stampable and writable protective layer of Example 1, the coverage on a dry basis of the coating liquid for water resistant micro-region formation was changed to 5.0 g/m$^2$ and the coverage on a dry basis of the coating liquid for water absorptive micro-region formation was changed to 0.5 g/m$^2$.

The stampable and writable protective layer of Comparative Example 3 thus formed had a mass ratio between constituents of the water resistant micro-regions and constituents of water absorptive micro-regions (constituents of water absorptive micro-regions/constituents of water resistant micro-regions) of 0.10 on a dry basis.

The protective layer transfer sheet of Comparative Example 3 prepared above was put on top of a black solid image formed in the same manner as in Example 1, and the thermally transferable protective layer was transferred by the same printer as used in the formation of the black solid image to form a black solid image with a protective layer.

As a result, in the print with a protective layer prepared in Comparative Example 3, upon penetration of an aqueous ink into the thermally transferred protective layer, the speed of the penetration of the aqueous ink at which the aqueous ink arrived at the stampable and writable protective layer was so low that the drying speed of the aqueous stamp and ink was low, and the stampability and the writability were poor.

Prints with a protective layer thermally transferred on the surface of black solid images of Examples 1 to 3 and Comparative Examples 1 to 3 were evaluated for water resistance by the following evaluation method and evaluation criteria.

[Water Resistance]

The upper part of the protective layer in each of the prints prepared using the protective layer transfer sheets of Examples 1 to 3 and Comparative Examples 1 to 3 was rubbed with a tap water-impregnated swab (antimicrobial swab H101, manufactured by PIP-TOKYO Co., Ltd.) by reciprocating the swag under a load of 10 g ten times. Thereafter, the degree of staining of the black solid image part with the protective layer was visually inspected and was evaluated according to the following criteria. The results are shown in Table 1.

(Evaluation Criteria)

TABLE 1

| | Coverage of coating liquid for porous layer, g | Coverage of water absorptive resin coating liquid, g | Mass ratio | Water resistance |
|---|---|---|---|---|
| Ex. 1 | 3.0 | 0.5 | 0.17 | ○ |
| Ex. 2 | 2.0 | 0.5 | 0.25 | ○ |
| Ex. 3 | 1.5 | 0.5 | 0.33 | ○ |
| Comp. Ex. 1 | 1.5 | 0.6 | 0.40 | X |

TABLE 1-continued

| | Coverage of coating liquid for porous layer, g | Coverage of water absorptive resin coating liquid, g | Mass ratio | Water resistance |
|---|---|---|---|---|
| Comp. Ex. 2 | 1.5 | 1.0 | 0.67 | X |
| Comp. Ex. 3 | 5.0 | 1.0 | 0.10 | X |

○: No damage to black solid image part, and no problem
X: Thermally transferred protective layer rubbed away, posing a problem As is apparent from the results shown in Table 1, for the prints with a protective layer prepared using the protective layer transfer sheets of Examples 1 to 3 in which the mass ratio between the constituents of the water resistant micro-regions and the constituents of the water absorptive micro-regions (constituents of water absorptive micro-regions/constituents of water resistant micro-regions) was in the range of more than 0.1 to less than 0.4 on a dry basis; there was no damage to the black solid image part and the water resistance was better than that in the product (conventional product) of Comparative Example 1.

On the other hand, for the prints with a protective layer prepared using the protective layer transfer sheets of Comparative Examples 1 to 3 in which the mass ratio between the constituents of the water resistant micro-regions and the constituents of the water absorptive micro-regions was not in the above range on a dry basis, the thermally transferred protective layer was rubbed away and the water resistance was poor.

The invention claimed is:

1. A protective layer transfer sheet comprising: a substrate sheet; and a thermally transferable protective layer provided on at least a part of one side of the substrate sheet, wherein said thermally transferable protective layer forms a protective layer having a water absorptive property upon thermal transfer and comprises at least a peel layer, a stampable and writable protective layer, and a heat-adhesive resin layer provided in that order as viewed from the substrate sheet side, said stampable and writable protective layer comprises water resistant micro-regions, which are resistant to water and porous, and water absorptive micro-regions formed of a water absorptive resin, and the mass ratio on a dry basis between constituents of the water resistant micro-regions and constituents of the water absorptive micro-regions is greater than 0.1 but less than 0.4.

2. The protective layer transfer sheet according to claim 1, wherein said thermally transferable protective layer and at least one of a thermally sublimable colorant layer and a heat-fusion colorant layer are provided in a face serial manner on an identical substrate film.

3. A print comprising a thermally transferred image covered with a protective layer which has been thermally transferred from the protective layer transfer sheet according to claim 1 or 2.

4. The print according to claim 3, wherein a stamp can be affixed with an aqueous ink onto the thermally transferred protective layer in the print.

* * * * *